US006090022A

United States Patent [19]

Colecchi

[11] Patent Number: 6,090,022

[45] Date of Patent: Jul. 18, 2000

[54] EXERCISE APPARATUS

[76] Inventor: Anthony P. Colecchi, 624 Monogahela Ave. #4, Glassport, Pa. 15045

[21] Appl. No.: 09/258,337

[22] Filed: Feb. 25, 1999

[51] Int. Cl.[7] ..... A63B 21/00

[52] U.S. Cl. ..... 482/131; 901/142

[58] Field of Search ..... 5/616, 617, 610, 5/634; 482/901, 142, 131, 133, 130, 138; 601/23, 24; 606/241; 3/33–35

[56] References Cited

U.S. PATENT DOCUMENTS

| | | | |
|---|---|---|---|
| 517,928 | 4/1894 | Liechty | 5/634 |
| 539,039 | 5/1895 | Darre | 5/634 |
| 1,336,197 | 4/1920 | Clampett | 5/617 |
| 3,089,150 | 5/1963 | Briggs et al. | 5/615 |
| 5,137,504 | 8/1992 | Mangini | 482/131 |
| 5,277,681 | 1/1994 | Holt | 482/112 |
| 5,616,110 | 4/1997 | Nascimento | 482/131 |
| 5,970,545 | 10/1999 | Garman | 5/615 |

*Primary Examiner*—Jerome Donnelly

[57] ABSTRACT

A exercise apparatus for exercising a user's stomach, back and leg muscles. The exercise apparatus includes a base frame with a front post upwardly extending therefrom. A bench is pivotally coupled to the base frame and attached to the front post. A backrest is pivotally coupled to the bench. A motor with a pair of opposite outwardly extending rotating shafts is mounted under the bench. A pair of side posts upwardly extend from the base frame and each have a pulley rotatably mounted thereto. Each of the rotating shafts has a spool coupled thereto. A pair of elongate flexible cables are coupled to the backrest with a first of the cables looped around one of the pulleys and wound around one of the spools and a second of the cables looped around the other of the pulleys and wound around the other of the spools.

8 Claims, 4 Drawing Sheets

EXERCISE APPARATUS

BACKGROUND OF THE INVENTION

1. Field of the Invention

The present invention relates to exercise apparatuses and more particularly pertains to a new exercise apparatus for exercising a user's stomach, back and leg muscles.

2. Description of the Prior Art

The use of exercise apparatuses is known in the prior art. More specifically, exercise apparatuses heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,125,258 by McArthur; U.S. Pat. No. 5,190,513 by Habing et al; U.S. Pat. No. 4,647,040 by Ehrenfried; U.S. Pat. No. 4,478,411 by Baldwin; U.S. Pat. No. 3,012,776 by Hotas; and U.S. Pat. No. 2,831,687 by Hunter.

While these devices fulfill their respective, particular objectives and requirements, the aforementioned patents do not disclose a new exercise apparatus. The inventive device includes a base frame with a front post upwardly extending therefrom. A bench is pivotally coupled to the base frame and attached to the front post. A backrest is pivotally coupled to the bench. A motor with a pair of opposite outwardly extending rotating shafts is mounted under the bench. A pair of side posts upwardly extend from the base frame and each have a pulley rotatably mounted thereto. Each of the rotating shafts has a spool coupled thereto. A pair of elongate flexible cables are coupled to the backrest with a first of the cables looped around one of the pulleys and wound around one of the spools and a second of the cables looped around the other of the pulleys and wound around the other of the spools.

In these respects, the exercise apparatus according to the present invention substantially departs from the conventional concepts and designs of the prior art, and in so doing provides an apparatus primarily developed for the purpose of exercising a user's stomach, back and leg muscles.

SUMMARY OF THE INVENTION

In view of the foregoing disadvantages inherent in the known types of exercise apparatuses now present in the prior art, the present invention provides a new exercise apparatus construction wherein the same can be utilized for exercising a user's stomach, back and leg muscles.

The general purpose of the present invention, which will be described subsequently in greater detail, is to provide a new exercise apparatus and method which has many of the advantages of the exercise apparatuses mentioned heretofore and many novel features that result in a new exercise apparatus which is not anticipated, rendered obvious, suggested, or even implied by any of the prior art exercise apparatuses, either alone or in any combination thereof.

To attain this, the present invention generally comprises a base frame with a front post upwardly extending therefrom. A bench is pivotally coupled to the base frame and attached to the front post. A backrest is pivotally coupled to the bench. A motor with a pair of opposite outwardly extending rotating shafts is mounted under the bench. A pair of side posts upwardly extend from the base frame and each have a pulley rotatably mounted thereto. Each of the rotating shafts has a spool coupled thereto. A pair of elongate flexible cables are coupled to the backrest with a first of the cables looped around one of the pulleys and wound around one of the spools and a second of the cables looped around the other of the pulleys and wound around the other of the spools.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new exercise apparatus and method which has many of the advantages of the exercise apparatuses mentioned heretofore and many novel features that result in a new exercise apparatus which is not anticipated, rendered obvious, suggested, or even implied by any of the prior art exercise apparatuses, either alone or in any combination thereof.

It is another object of the present invention to provide a new exercise apparatus which may be easily and efficiently manufactured and marketed.

It is a further object of the present invention to provide a new exercise apparatus which is of a durable and reliable construction.

An even further object of the present invention is to provide a new exercise apparatus which is susceptible of a low cost of manufacture with regard to both materials and labor, and which accordingly is then susceptible of low prices of sale to the consuming public, thereby making such exercise apparatus economically available to the buying public.

Still yet another object of the present invention is to provide a new exercise apparatus which provides in the apparatuses and methods of the prior art some of the advantages thereof, while simultaneously overcoming some of the disadvantages normally associated therewith.

Still another object of the present invention is to provide a new exercise apparatus for exercising a user's stomach, back and leg muscles.

Yet another object of the present invention is to provide a new exercise apparatus which includes a base frame with a front post upwardly extending therefrom. A bench is pivotally coupled to the base frame and attached to the front post. A backrest is pivotally coupled to the bench. A motor with a pair of opposite outwardly extending rotating shafts is mounted under the bench. A pair of side posts upwardly extend from the base frame and each have a pulley rotatably mounted thereto. Each of the rotating shafts has a spool coupled thereto. A pair of elongate flexible cables are coupled to the backrest with a first of the cables looped around one of the pulleys and wound around one of the spools and a second of the cables looped around the other of the pulleys and wound around the other of the spools.

Still yet another object of the present invention is to provide a new exercise apparatus that has a motor for controlling the repetition rate of the exercise.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
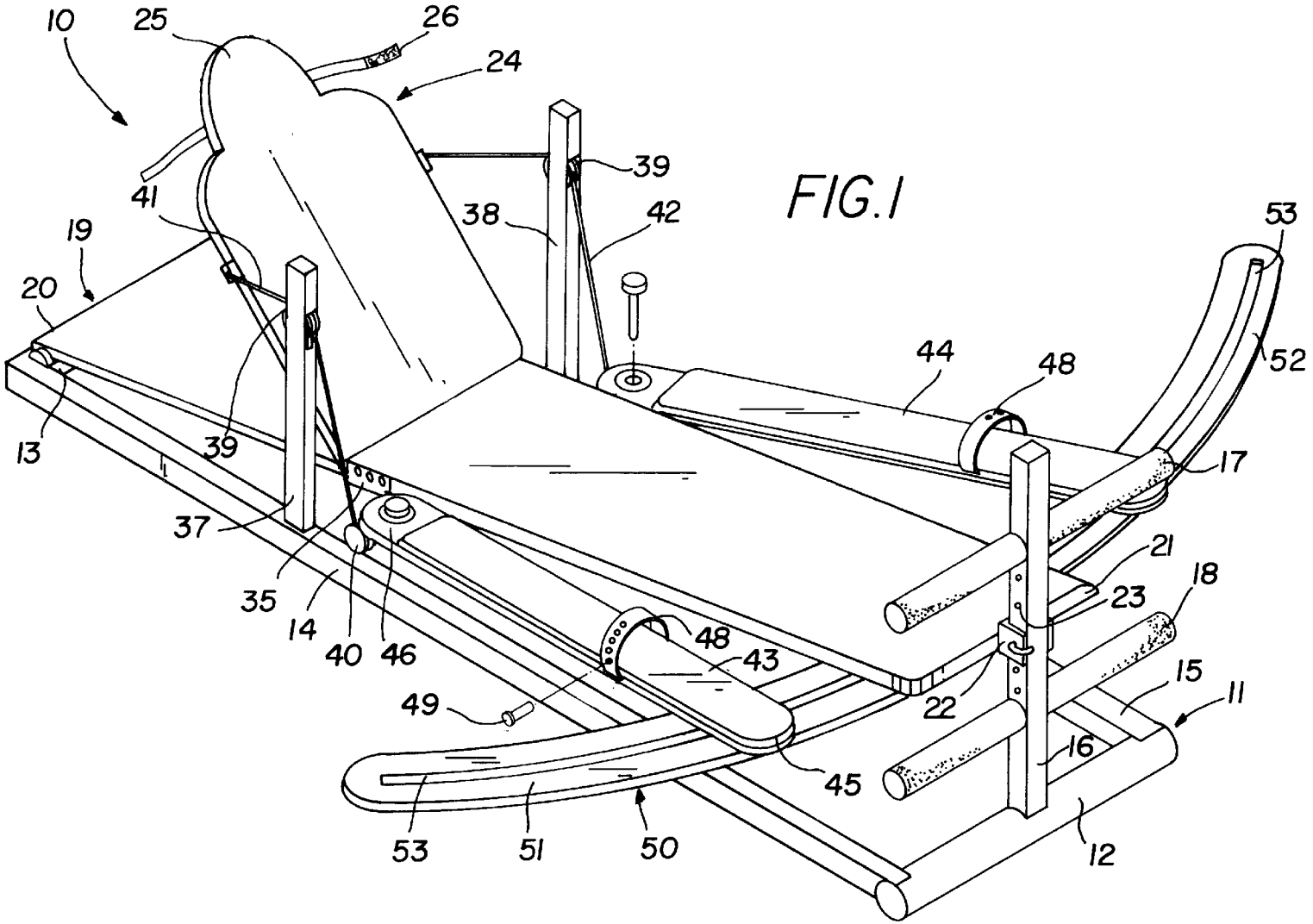
FIG. 1 is a schematic perspective view of a new exercise apparatus according to the present invention.
Figure 2:
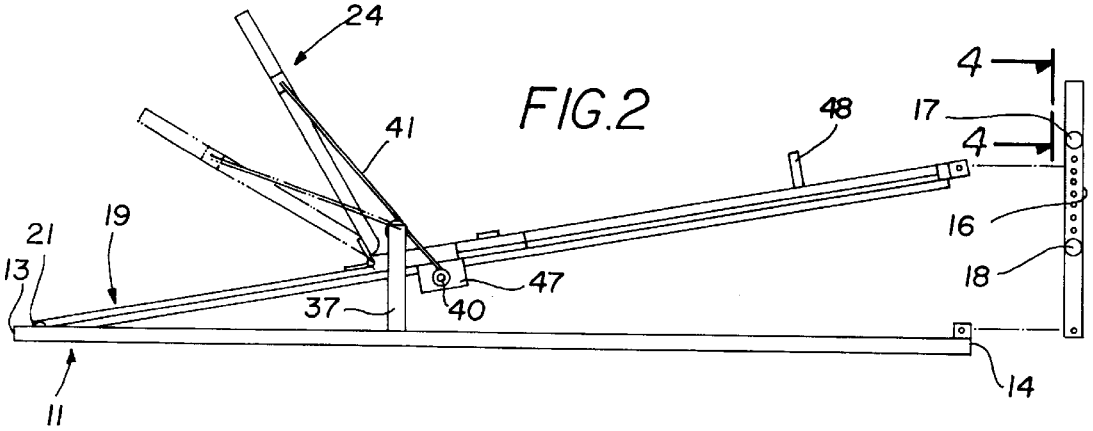
FIG. 2 is a schematic side view of the present invention illustrating the pivoting of the backrest.
Figure 3:
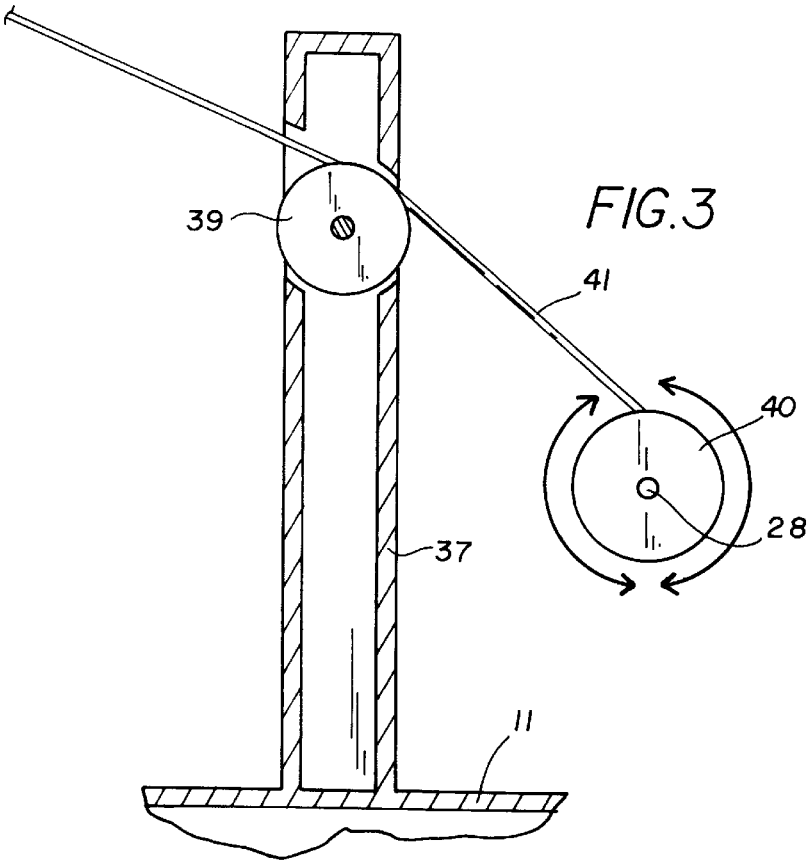
FIG. 3 is a schematic cross sectional view of a side post of the present invention.

With reference now to the drawings, and in particular to FIGS. 1 through 6 thereof, a new exercise apparatus embodying the principles and concepts of the present invention and generally designated by the reference numeral 10 will be described.

As best illustrated in FIGS. 1 through 6, the exercise apparatus 10 generally comprises a base frame with a front post upwardly extending therefrom. A bench is pivotally coupled to the base frame and attached to the front post. A backrest is pivotally coupled to the bench. A motor with a pair of opposite outwardly extending rotating shafts is mounted under the bench. A pair of side posts upwardly extend from the base frame and each have a pulley rotatably mounted thereto. Each of the rotating shafts has a spool coupled thereto. A pair of elongate flexible cables are coupled to the backrest with a first of the cables looped around one of the pulleys and wound around one of the spools and a second of the cables looped around the other of the pulleys and wound around the other of the spools.

In closer detail, the exercise apparatus 10 comprises an open generally rectangular base frame 11 has spaced apart and substantially parallel elongate front and back bars 12,13, and a space apart pair of substantially parallel elongate side bars 14,15 extending between the front and back bars of the base frame. In use, the base frame is designed for resting on a floor surface. Preferably, the front bar of the base frame is generally cylindrical in shape for providing greater comfort to a user lifting the base frame while grasping the front bar.

A substantially vertical elongate front post 16 is upwardly extended from the front bar of the base frame. Preferably, the front post is adjustably extendable to permit adjustable extension of the height of the front post. The front post has substantially horizontal upper and lower pairs 17,18 of opposite foot bars outwardly extending therefrom. The foot bars each ideally has an outer layer comprising a resiliently deformable foamed material for added comfort to the feet of a user resting against the foot bars.

A generally rectangular and generally planar bench 19 is provided having front and back ends, and a pair of sides extending between the front and back ends of the bench. The back end 20 of the bench is pivotally coupled to the back bar of the base frame so that the bench is forwardly extended from the back bar of the base frame towards the front bar of the base frame. The front end 21 of the bench is detachably and adjustably attached to the front post with a mounting bracket 22 and a plurality of holes 23 in the front post to permit positioning of the bench at a selected acute angle with respect to the plane in which the base frame lies. Preferably, the front end of the bench is coupled to the front post between the upper and lower pairs of foot bars.

A generally rectangular backrest 24 is upwardly extended from the bench at a position between the front and back ends of the bench. The backrest is pivotally coupled to the bench to permit reclining and upright positioning of the backrest with respect to the bench. With general reference to FIG. 2, in use, the backrest has an upright position where the backrest is upwardly extended generally perpendicular to the bench and a reclined position where the backrest is pivoted downwards from the upright position towards the back end of the bench so that the backrest is generally parallel to the bench. Preferably, a spring at the pivot coupling between the backrest and bench biases the backrest towards the upright position.

The backrest preferably has a generally semi-circular headrest 25 upwardly extending therefrom. The headrest has a pair of opposite flexible head straps 26 outwardly extending therefrom with the ends of the head straps being detachably attached together by a hook and loop fastener to secure a user's head to the headrest when the user is sitting on the bench with their back on the backrest.

Figure 5:
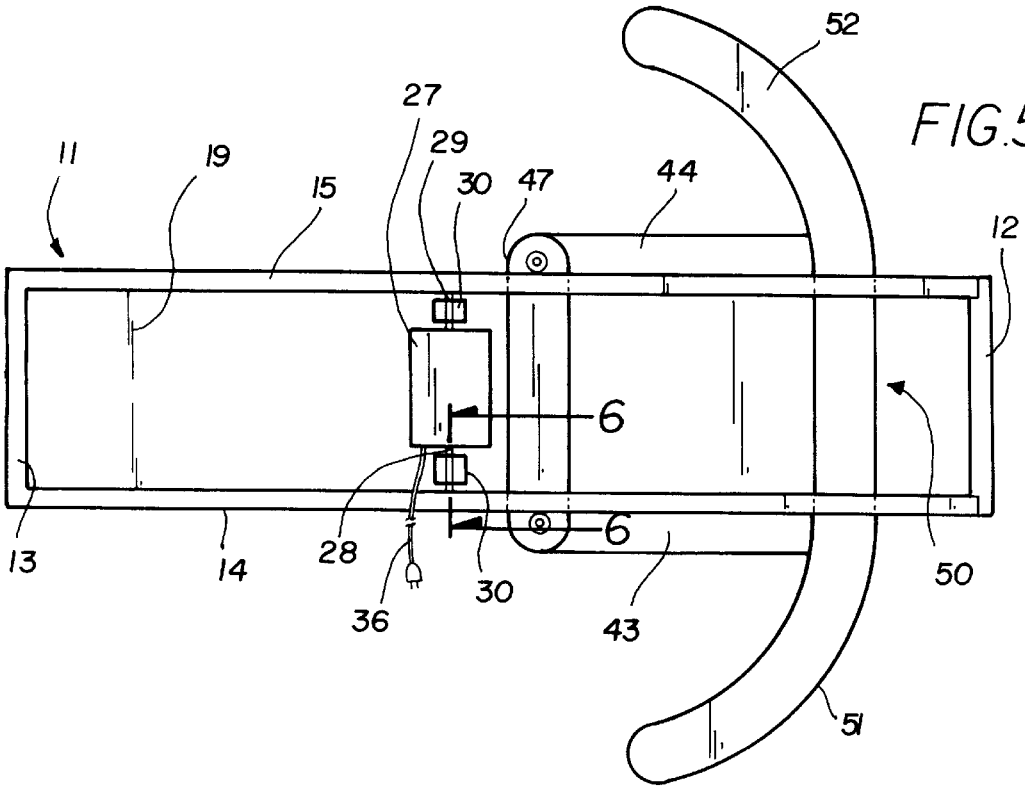
FIG. 5 is a schematic bottom view of the present invention.

A motor 27 is provided with a pair of opposite outwardly extending rotating shafts 28,29. As illustrated in FIG. 5, the motor is mounted to a bottom face of the bench adjacent the backrest. One of the rotating shafts of the motor is outwardly extended towards one side of the bench. The other of the rotating shafts of the motor is outwardly extended towards the other of the sides of the bench.

Figure 6:
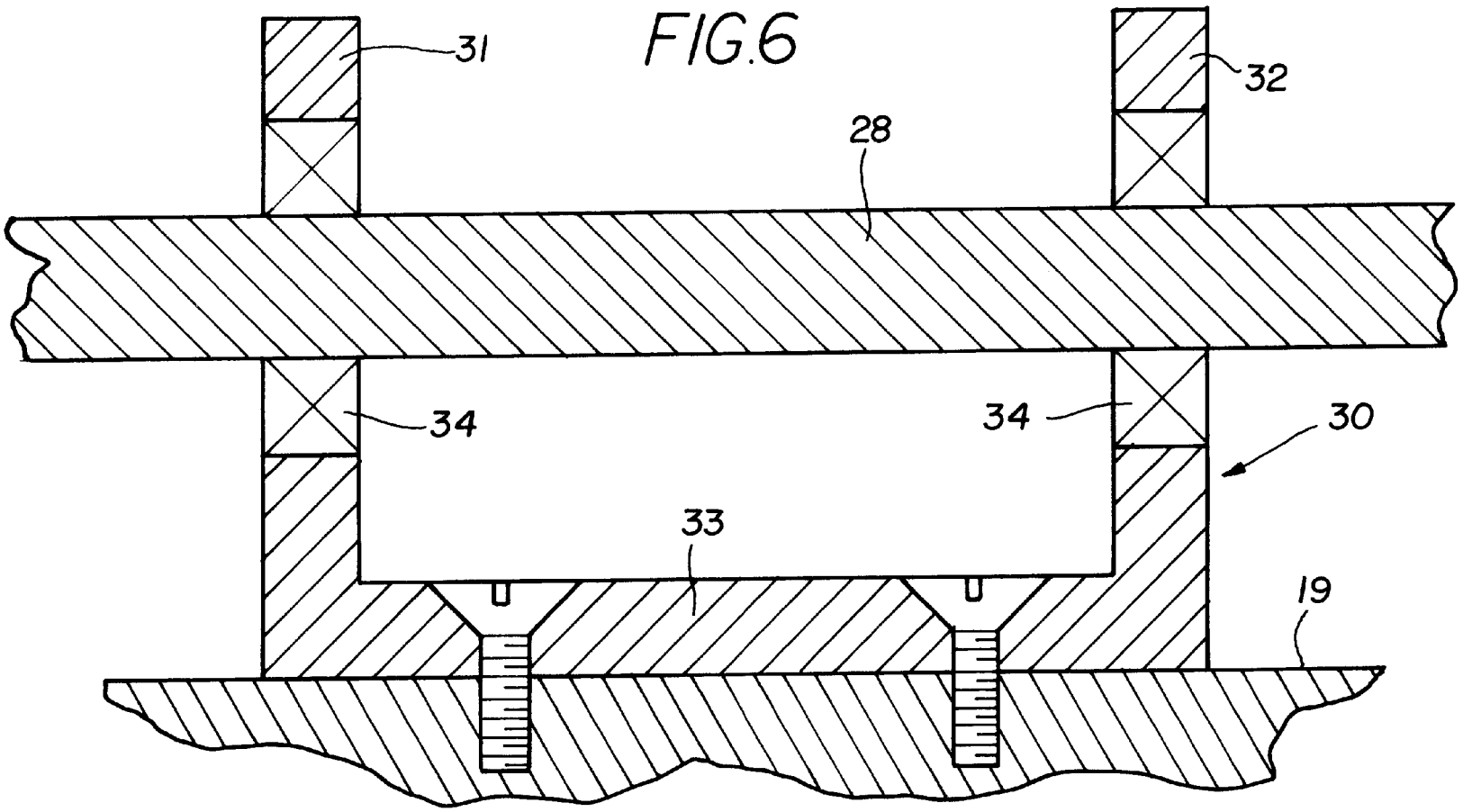
FIG. 6 is a schematic cross sectional view of a bracket of the present invention taken from line 6—6 of FIG. 5.

Each of the rotating shafts preferably has a bracket 30 rotatably coupling the respective rotating shaft to the bottom face of the bench. As illustrated in FIG. 6, each of the brackets has a spaced apart pair of arms 31,32 and a cross portion 33 connecting the arms of the respective bracket together. The cross portion of each bracket is coupled to the bottom face of the bench. Each of the rotating shafts is extended through the arms of the respective bracket to permit free rotation of the rotating shafts. Preferably, the arms of each bracket has a bearing 34 disposed around the associated rotating shaft.

Preferably, the motor has a switch or control panel 35 for activating and deactivating the motor to rotate the rotating shafts which is mounted to a side of the bench. The motor also preferably has an electrical power cable 36 outwardly extending therefrom to permit connection of the motor to an electrical power source.

A spaced apart pair of substantially vertical side posts 37,38 upwardly extend from the base frame such that the bench is positioned between the side posts. One of the side posts is coupled to one of the side bars of the base frame and the other of the side posts is coupled to the other of the side bars of the base frame. Each of the side posts has a pulley 39 rotatably mounted thereto towards the upper end of the respective side post.

Each of the rotating shafts has a spool 40 coupled thereto. A pair of elongate flexible cables 41,42 are provided each having a pair of opposite ends. One end of the each of the cables is coupled to the backrest as illustrated in FIG. 1. A first of the cables is looped around one of the pulleys and the other end of the first cable is wound around one of the spools. Similarly, a second of the cables is looped around the other of the pulleys and the other end of the second cable is wound around the other of the spools.

In use, rotation of the rotating shafts in first directions further wraps the cables about the spools to pivot the backrest towards the upright position. Conversely, rotation of the rotating shafts in second directions unwinds the cables about the spools to pivot the backrest towards the reclined position. The motor alternates rotation of the rotating shafts in the first and second directions so that the backrest is pivoted back and forth repeatedly between the upright and reclined positions.

A pair of elongate leg rests 43,44 are provided each having opposite forwards and rearwards ends 45,46. The rearwards end of a first of the leg rest is pivotally coupled to one of the sides of the bench and the rearwards end of a second of the leg rest is pivotally coupled to the other of the sides of the bench. In use, the leg rests are pivotable in a generally horizontal plane about a generally vertical pivot axis. Ideally, as illustrated in FIG. 5, an elongate brace 47 is coupled to the bottom face of the bench and has a pair of opposite ends outwardly extending from either side of the bench. The rearwards ends of the leg rests each are pivotally coupled to an adjacent end of the brace to pivotally coupled the rearwards ends of the leg rest to the associated side of the bench. Preferably, each of the leg rests has a leg strap 48 for holding a user's leg to the respective leg rest. The leg straps preferably each have a release pin 49 detachably and adjustably attaching the respective leg strap to its associated leg rest to permit adjustment of the location of the leg straps along the lengths of the leg rests.

An arcuate bow shape guide 50 is provided having opposite and arcuate first and second end portions 51,52. The guide is coupled to the bottom face of the bench such that the first end portion of the guide outwardly extends from one of the sides of the bench and the second end portion of the guide outwardly extends from the other of the sides of the bench. The end portions of the guide curve towards the back end of the bench and each have an elongate arcuate upper channel therealong. The forwards end of one of the leg rest has a downwardly depending extent slidably inserted into the upper channel of the first end portion of the guide to permit sliding of the one leg rest along the first end portion of the guide. Similarly, the forwards end of the other of the leg rests has a downwardly depending extent slidably inserted into the upper channel of the second end portion of the guide to permit sliding of the other leg rest along the second end portion of the guide.

Figure 4:
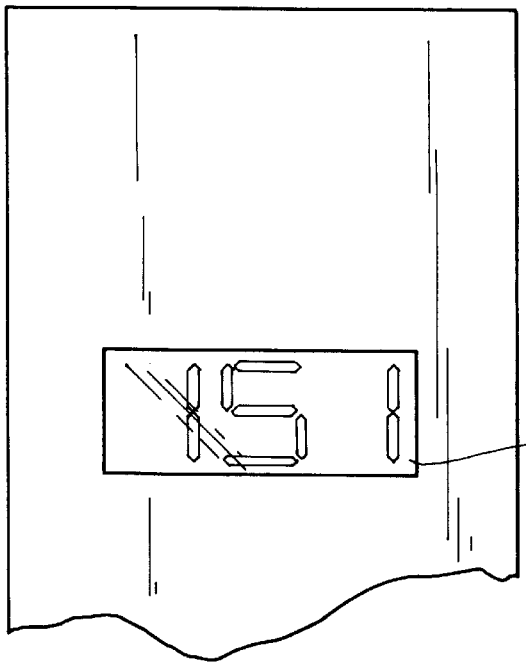
FIG. 4 is a schematic enlarged plan view of the upper end of the front post of the present invention illustrating the visual display of the counter taken from the vantage of line 4—4 of FIG. 2.

Ideally, a counter is connected to the motor for counting the number of times the motor completes a repetition between rotating the rotating shafts in the first and second directions (in other words, for counting each repetition that the backrest is reclined and then pivoted upright). The counter has a digital visible display 54 for displaying numerical indicia for indicating the number of repetitions performed by the motor. As illustrated in FIG. 4, the visible display is mounted on the front post adjacent an upper end of the front post and facing towards the back end of the back rest.

Ideally, the upper face of the bench, the forwards face of the backrest and the upper faces of the leg rests all have an resiliently deformable foamed material padded upper layer for providing comfort to a user.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the forego ing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercise apparatus, comprising:

a base frame;

a front post being upwardly extended from said base frame;

a bench having front and back ends, and a pair of sides extending between said front and back ends of said bench;

said back end of said bench being pivotally coupled to said base frame;

said front end of said bench being attached to said front post;

a backrest being pivotally coupled to said bench;

a motor having a pair of opposite outwardly extending rotating shafts, said motor being mounted to said bench adjacent said backrest;

one of said rotating shafts of said motor being outwardly extended towards one side of said bench, the other of said rotating shafts of said motor being outwardly extended towards the other of said sides of said bench;

a pair of side posts upwardly extending from said base frame such that said bench is positioned between said side posts;

each of said side posts having a pulley rotatably mounted thereto;

each of said rotating shafts having a spool coupled thereto;

a pair of elongate flexible cables each having a pair of opposite ends, one end of said each of said cables being coupled to said backrest; and a first of said cables being looped around one of said pulleys and the other end of said first cable being wound around one of said spools, a second of said cables being looped around the other of said pulleys and the other end of said second cable being wound around the other of said spools.

2. The exercise apparatus of claim 1, further comprising a pair of elongate leg rests each having opposite forwards and rearwards ends, said rearwards end of a first of said leg rest being pivotally coupled to one of said sides of said bench, said rearwards end of a second of said leg rest being pivotally coupled to the other of said sides of said bench, and further comprising an arcuate bow shape guide having opposite and arcuate first and second end portions, said guide being coupled to said bench such that said first end portion of said guide outwardly extends from one of said sides of said bench and said second end portion of said guide outwardly extends from the other of said sides of said bench, wherein said end portions of said guide each have an elongate arcuate upper channel therealong, and wherein said forwards end of one of said leg rest is slidably inserted into said upper channel of said first end portion of said guide and said forwards end of the other of said leg rests is slidably inserted into said upper channel of said second end portion of said guide.

3. The exercise apparatus of claim 1, wherein base frame further comprises front and back bars, and a pair of side bars extending between said front and back bars of said base frame, wherein said front bar of said base frame is generally cylindrical in shape.

4. The exercise apparatus of claim 1, wherein said front post has upper and lower pairs of opposite foot bars outwardly extending therefrom.

5. The exercise apparatus of claim 1, wherein said backrest has a generally headrest upwardly extending therefrom, said headrest having a pair of opposite flexible head straps outwardly extending therefrom, said head straps being detachably attached together.

6. The exercise apparatus of claim 1, wherein each of said rotating shafts has a bracket rotatably coupling the respective rotating shaft to said bottom face of said bench, each of said brackets having a spaced apart pair of arms and a cross portion connecting said arms of the respective bracket together, said cross portion of each bracket being coupled to said bottom face of said bench, each of said rotating shafts being extended through said arms of said respective bracket to permit free rotation of said rotating shafts, said arms of each bracket having a bearing disposed around the associated rotating shaft.

7. The exercise apparatus of claim 1, further comprising a counter being connected to said motor, said counter having a visible display mounted on said front post.

8. An exercise apparatus, comprising:

an open generally rectangular base frame having spaced apart and substantially parallel elongate front and back bars, and a space apart pair of substantially parallel elongate side bars extending between said front and back bars of said base frame;

said front bar of said base frame being generally cylindrical in shape;

a substantially vertical elongate front post being upwardly extended from said front bar of said base frame, said front post being adjustably extendable;

said front post having substantially horizontal upper and lower pairs of opposite foot bars outwardly extending therefrom, said foot bars each having an outer layer comprising a resiliently deformable foamed material;

a generally rectangular and generally planar bench having front and back ends, and a pair of sides extending between said front and back ends of said bench;

said back end of said bench being pivotally coupled to said back bar of said base frame, said bench being forwardly extended from said back bar of said base frame towards said front bar of said base frame;

said front end of said bench being detachably and adjustably attached to said front post;

said front end of said bench being coupled to said front post between said upper and lower pairs of foot bars;

a generally rectangular backrest being upwardly extended from said bench at a position between said front and back ends of said bench, said backrest being pivotally coupled to said bench;

said backrest having a generally semi-circular headrest upwardly extending therefrom, said headrest having a pair of opposite flexible head straps outwardly extending therefrom, said head straps being detachably attached together;

a motor having a pair of opposite outwardly extending rotating shafts, said motor being mounted to a bottom face of said bench adjacent said backrest;

one of said rotating shafts of said motor being outwardly extended towards one side of said bench, the other of said rotating shafts of said motor being outwardly extended towards the other of said sides of said bench;

each of said rotating shafts having a bracket rotatably coupling the respective rotating shaft to said bottom face of said bench;

each of said brackets having a spaced apart pair of arms and a cross portion connecting said arms of the respective bracket together, said cross portion of each bracket being coupled to said bottom face of said bench;

each of said rotating shafts being extended through said arms of said respective bracket to permit free rotation of said rotating shafts, said arms of each bracket having a bearing disposed around the associated rotating shaft;

a spaced apart pair of substantially vertical side posts upwardly extending from said base frame such that said bench is positioned between said side posts;

one of said side posts being coupled to one of said side bars of said base frame, the other of said side posts being coupled to the other of said side bars of said base frame;

each of said side posts having an upper end and a pulley rotatably mounted thereto towards said upper end of the respective side post;

each of said rotating shafts having a spool coupled thereto;

a pair of elongate flexible cables each having a pair of opposite ends, one end of said each of said cables being coupled to said backrest;

a first of said cables being looped around one of said pulleys and the other end of said first cable being wound around one of said spools, a second of said cables being looped around the other of said pulleys and the other end of said second cable being wound around the other of said spools;

a pair of elongate leg rests each having opposite forwards and rearwards ends, said rearwards end of a first of said leg rest being pivotally coupled to one of said sides of said bench, said rearwards end of a second of said leg rest being pivotally coupled to the other of said sides of said bench;

an arcuate bow shape guide having opposite and arcuate first and second end portions, said guide being coupled to said bottom face of said bench such that said first end portion of said guide outwardly extends from one of said sides of said bench and said second end portion of said guide outwardly extends from the other of said sides of said bench;

said end portions of said guide curving towards said back end of said bench;

said end portions of said guide each having an elongate arcuate upper channel therealong;

said forwards end of one of said leg rest being slidably inserted into said upper channel of said first end portion of said guide, said forwards end of the other of said leg rests being slidably inserted into said upper channel of said second end portion of said guide;

a counter being connected to said motor; and said counter having a visible display, said visible display being mounted on said front post.

* * * * *